US006196074B1

(12) United States Patent
Varhol

(10) Patent No.: US 6,196,074 B1
(45) Date of Patent: Mar. 6, 2001

(54) DIFFUSION SAMPLER AND METHOD OF USE

(76) Inventor: Bradley P. Varhol, 4320 Horder Ct., Lithonia, GA (US) 30058

( * ) Notice: Subject to any disclaimer, the term of this patent is extended or adjusted under 35 U.S.C. 154(b) by 0 days.

(21) Appl. No.: 09/323,613

(22) Filed: Jun. 1, 1999

Related U.S. Application Data

(60) Provisional application No. 60/087,699, filed on Jun. 2, 1998.

(51) Int. Cl.[7] ..... E21B 49/08
(52) U.S. Cl. ..... 73/863.23
(58) Field of Search ..... 73/863.21, 863.23, 73/864.51, 864.63

(56) References Cited

U.S. PATENT DOCUMENTS

| | | | | |
|---|---|---|---|---|
| 4,266,429 | * | 5/1981 | Brovold | 73/864.63 |
| 4,852,413 | * | 8/1989 | Niskin et al. | 73/864.63 |
| 5,139,654 | * | 8/1992 | Carpenter | 73/864.63 |
| 5,235,863 | * | 8/1993 | Bailey et al. | 73/863.21 |
| 5,804,743 | | 9/1998 | Vroblesky et al. . | |
| 5,878,813 | * | 3/1999 | Ridgeway, Jr. | 73/864.63 |
| 5,996,423 | * | 12/1999 | Baghel et al. | 73/863.23 |

OTHER PUBLICATIONS

Vroblesky, Don A. and Hyde, W. Thomas, "Diffusion Samples as an Inexpensive Approach to Monitoring VOCs' in Ground Water," Ground Water Monitoring Review, Summer 1997, pp. 177–184 (United States Publication).

* cited by examiner

*Primary Examiner*—Robert Raevis
(74) *Attorney, Agent, or Firm*—Hughes & Kaplan; Barry E. Kaplan

(57) ABSTRACT

Embodiments of a diffusion sampler device and method of use are shown and described, each having a semi-permeable membrane, a top portion having a handle, a nozzle portion, a plug portion, and means to join the assembly together. The diffusion sampler of the present invention is adapted to be provided with a mesh to protect the membrane against abrasion and, further, to accommodate and principally carry the weight of the diffusion sampler and its contents. A novel valve means is also disclosed for use with the diffusion sampler of the present invention. The valve means will carry the specimen from the membrane into a sampling vial or container with a smooth, nearly laminar flow. The diffusion sampler may be provided with attachment means to accommodate such weights and tethers as may be required during use of the device. A separate fill kit is optionally provided for convenience and accuracy in the sampling process.

20 Claims, 2 Drawing Sheets

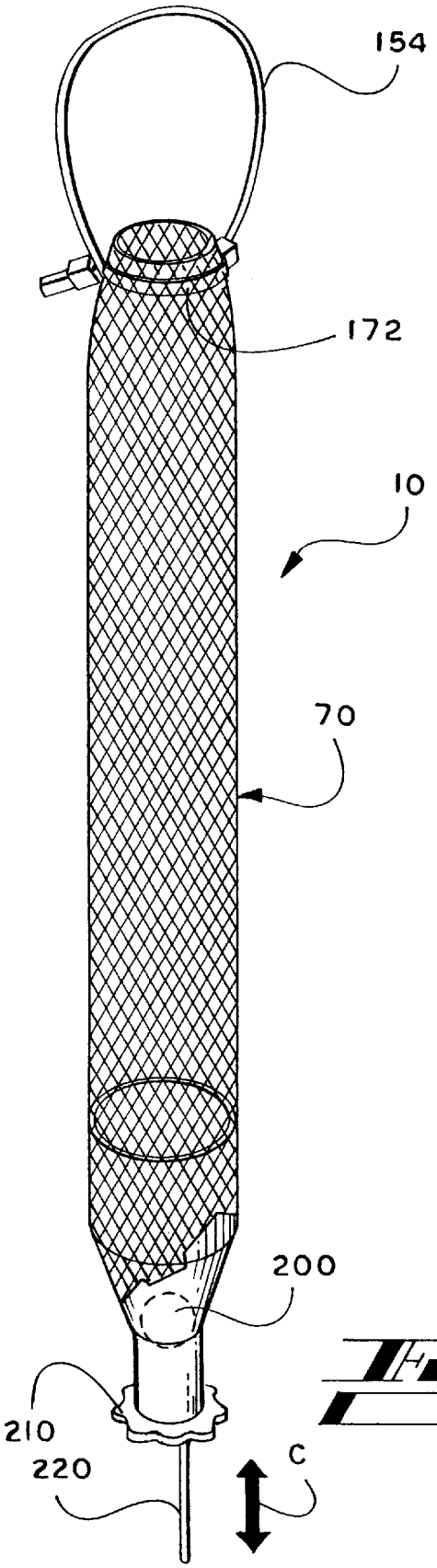
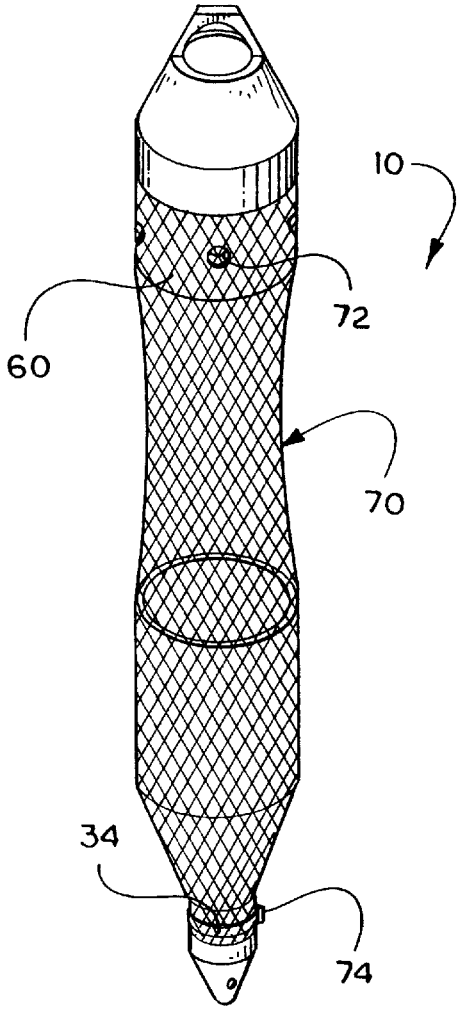
Fig_2
Fig_3

DIFFUSION SAMPLER AND METHOD OF USE

RELATED APPLICATIONS

The inventor hereof claims priority based upon and pursuant to provisional patent application Ser. No. 60/087,699 filed on Jun. 2, 1998.

FIELD OF THE INVENTION

This invention relates generally to ground water contamination sampling systems; and, more particularly, to an apparatus for sampling ground water using the process of molecular diffusion.

BACKGROUND OF THE INVENTION

The process of testing ground water for contamination may be time consuming, expensive, and environmentally unfriendly. Often, it is desirable to test ground water for contaminants known as "VOCs," or volatile organic compounds. It has been recognized in the art that polyethylene is permeable to volatile organic compounds, including chlorinated VOCs, benzene, and toluene. In accordance with that recognition, others have developed a process called "diffusion sampling" or "passive sampling." The diffusion sampling process takes advantage of the permeability of polyethylene membranes to water-borne VOC contaminants.

In accordance with this technique, a polyethylene bag or membrane is filled with distilled water, sealed, and lowered into the aquifer to be tested. After a sufficient period of time, the VOC contaminants permeate the membrane. Eventually, equilibrium is established between the VOC concentration in the surrounding ground water and the sample in the membrane. The membrane is then withdrawn and the sample is tested.

Don A. Vroblesky and W. Thomas Hyde document both the technical process and their prior art diffusion sampling device in an article entitled, "Diffusion Samplers as an Inexpensive Approach to Monitoring VOCs in Ground Water," Ground Water Monitoring Review, Summer 1997, pp. 177–184. In that article, the authors further discuss the need for withdrawing a specimen from the diffusion sampler without aeration. Aeration of the specimen would render the sample unusable.

The device disclosed by Vroblesky and Hyde, however, has several apparent drawbacks. That device is difficult to use in the field due to the need to heat seal polyethylene bags which contain water. Further, that device provides no convenient method for withdrawing a specimen. Also, the device has little structure to which tether lines, weights, and the like may be conveniently and securely attached.

It is readily apparent that an improved diffusion sampling device is needed to overcome the drawbacks apparent in the prior art, and to render more convenient the diffusion sampling method for the testing of ground water. It is, therefore, to the provision of such an improved diffusion sampling device that the present invention is directed.

Accordingly, the several objects of the present invention are:

- to provide an improved diffusion sampler having convenient and reliable means to seal the device against leakage;
- to provide an improved diffusion sampler having convenient and reliable means for filling, weighting, lowering, and recovering the device;

- to provide an improved diffusion sampler having convenient and reliable means for extracting a test specimen, without degradation, from within the device;
- to provide an improved diffusion sampler which will resist deterioration through abrasion;
- to provide an improved diffusion sampler which is structurally reinforced against the mechanical stresses of the sampling environment;
- to provide an improved diffusion sampler which is reusable for multiple tests, yet may also be disposable at the end of its useful service life; and,
- to provide an improved diffusion sampler which is economical to manufacture, and which is simple and convenient to use under typical field conditions.

Other objects, features, and advantages of the present invention will become apparent to those skilled in the art by reference to the drawings and to the detailed description of the preferred embodiment presented herein.

BRIEF SUMMARY OF THE INVENTION

In accordance with the several objects of the present invention, disclosed is a diffusion sampler device having a semi-permeable membrane, a top portion having a handle, a nozzle portion, a plug portion, and means to join the assembly together. The diffusion sampler of the present invention is adapted to be provided with a mesh, as an optional feature, to protect the membrane against abrasion and, further, to accommodate and principally carry the weight of the diffusion sampler and its contents. A novel valve means is also disclosed for use with the diffusion sampler of the present invention. The valve means will carry the specimen from the membrane into a sampling vial or container with a smooth, nearly laminar flow. The valve means may also provide a convenient means for filling the diffusion sampler. The diffusion sampler may be provided with attachment means to accommodate such weights and tethers as may be required during use of the device.

BRIEF DESCRIPTION OF THE DRAWINGS

The invention is better understood by reading the Detailed Description of the Preferred Embodiments with reference to the accompanying drawing figures, in which like reference numerals denote similar structure and refer to like elements throughout, and in which:

FIG. 2 is a perspective view of an alternative embodiment of the diffusion sampler of the present invention;

FIG. 3 is a perspective view of another alternative embodiment of the diffusion sampler of the present invention, also demonstrating a novel valve means; and, FIG. 4 is an elevation view of the ring assembly provided for weighting the diffusion sampler of the present invention.

It is to be noted that the drawings presented are intended solely for the purpose of illustration and that they are, therefore, neither desired nor intended to limit the invention to any or all of the exact details of construction shown, except insofar as they may be deemed essential to the claimed invention.

DETAILED DESCRIPTION OF THE PREFERRED EMBODIMENT

In describing preferred embodiments of the present invention illustrated in the Figures, specific terminology is employed for the sake of clarity. The invention, however, is not intended to be limited to the specific terminology so selected, and it is to be understood that each specific element includes all technical equivalents which operate in a similar manner to accomplish a similar purpose.

Figure 1:
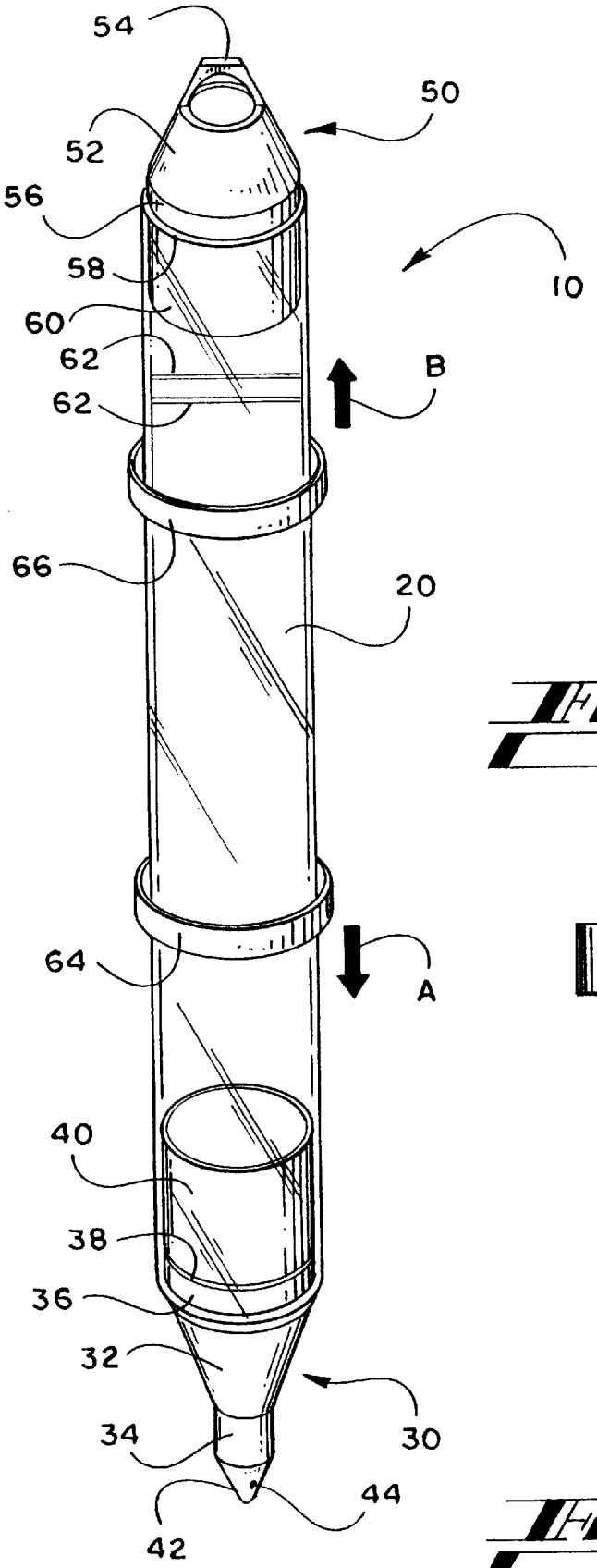
FIG. 1 is a perspective view of the preferred embodiment of the diffusion sampler of the present invention.

Shown in FIG. 1 is the preferred embodiment of the diffusion sampler 10 of the present invention. In that figure, the diffusion sampler 10 is shown oriented vertically, that being the principal axis of the sampler while in operation according to its intended use.

In accordance with those scientific principles attendant to the instant water sampling technique, provided at the central portion of diffusion sampler 10 is an appropriately dimensioned, semi-permeable membrane 20. In the preferred embodiment, the membrane 20 is provided as a flexible tube, or sleeve, of approximately circular cross-section. The membrane 20 of the preferred embodiment has an outside diameter of approximately 1½ inches and a wall thickness of between 0.001 to 0.010 inches, although a wall thickness of approximately 0.004 inches is preferred.

It will be recognized by those ordinarily skilled in the art that the length and diameter of the sleeve membrane 20 typically are selected with consideration to the sample volume required by the particular testing protocol being utilized. In that regard, the length and diameter of the membrane 20 may be varied in geometrical proportion, and according to formulae well-known in the art, in order to secure the required testing volume and to conform to the physical structure into which it is placed. The various other components of the present invention, each of which are to be discussed and described more fully hereinbelow, would then be sized to function effectively with the dimensions of the membrane so selected.

Similarly, the composition of the membrane 20 itself may be altered to provide or enhance properties conducive to diffusion transfer across the membrane of the particular contaminant materials to be studied. Accordingly, the efficacy of the membrane 20 may be optimized by selecting a membrane material appropriate to such molecular discrimination. It should be recognized by those ordinarily skilled in the art that the choice of composition of such membrane is not material to the invention herein disclosed, nor would the specific material so selected require departure from either the scope or spirit of the present invention. It should be further recognized that any or all of the membrane characteristics, including cross-sectional shape, outside dimensions, length, rigidity, permeability, and thickness, may be altered without departing from either the scope or spirit of the present invention.

A nozzle portion 30 is provided at the lower end of diffusion sampler 10. Nozzle portion 30 has a funnel-shaped portion 32 with a generally cylindrical outlet portion 34 at its lower end. Above the funnel-shaped portion 32 is a generally cylindrical extended wall portion 36. A shoulder portion 38 is provided to offset the extended wall portion 36 from flange 40.

A plug element 42 preferably is provided to seal the nozzle portion 30 against leakage during use. Plug element 42 may be provided in a form such that the outside diameter is sized so as to be insertable into the inside diameter of outlet portion 34, while maintaining a strong interference (frictional) fit. As will be discussed more fully hereinbelow, the plug element 42 may be removed to facilitate filling, sample testing, and emptying of diffusion sampler 10. The plug element 42 optionally may be provided with a slot or hole 44. Hole 44 does not open into the nozzle portion 30; rather, it provides a convenient means for insertion of a tool to remove plug element 42 from nozzle 34.

A top portion 50 is provided at the upper end of diffusion sampler 10. Top portion 50 has an upper body portion 52, shown in FIG. 1 as a frustoconically-shaped element. It will be appreciated, however, that the shape of the upper body portion 52 is selected for manufacturing convenience and is not material to the invention herein disclosed, nor would the specific shape so selected require departure from either the scope or spirit of the present invention. Rather, the significance of the top portion 50 and upper body portion 52 is to provide a means to support membrane 20 at its upper portion and to further provide a handle element. Although a preferred embodiment of this arrangement is provided immediately hereinbelow, alternative designs will be readily apparent to those ordinarily skilled in the art. One such alternative design is discussed later in this specification.

Accordingly, in the embodiment of the diffusion sampler 10 illustrated in FIG. 1, at the top of the upper body portion 52 is a handle portion 54, which provides a convenient location for attachment of optional weights, tether lines, and the like. The handle portion 54 also may be utilized to connect additional diffusion samplers in series. Below the upper body portion 52 is a generally cylindrical extended wall portion 56. A shoulder portion 58 is provided to offset the extended wall portion 56 from flange 60.

The embodiment of the present invention illustrated in FIG. 1 typically is assembled by forming at least one leak-proof seam 62 in the upper portion of membrane 20, as by heat-sealing the upper portion of membrane 20 through a conventional heat welding process. It will be recognized by those skilled in the art, however, that other mechanical means, such as clamping, may be utilized in lieu of heat sealing the membrane. Membrane 20 is inserted through clamping elements 64, 66. Nozzle portion 30 is inserted into the open, lower portion of membrane 20 so that the lower portion of membrane 20 overlays flange 40 by an amount sufficient to enable membrane 20 to be securely clamped. Preferably, the lower portion of membrane 20 overlaps the extended wall portion 36. Next, clamping element 64 is slid over flange 40, in the direction indicated by arrow A, and, optimally, is seated against shoulder portion 38. If required, clamping element 64 is tightened in a manner appropriate to the nature of the clamping element utilized.

In a similar manner, top portion 50 is inserted into the upper portion of membrane 20 above leak-proof seam 62, so that the upper portion of membrane 20 overlays flange 60 by an amount sufficient to enable membrane 20 to be securely clamped. Preferably, the upper portion of membrane 20 overlaps the extended wall portion 56. Next, clamping element 66 is slid over flange 60, in the direction indicated by arrow B, and, optimally, is seated against shoulder portion 58. If required, clamping element 66 is tightened in a manner appropriate to the nature of the clamping element utilized.

As a design consideration, it will be appreciated by those ordinarily skilled in the art that clamping elements 64, 66 may be selected from any of a variety of commercially available band clamps or filament clamps. Such clamps are widely available in any of a variety of materials. Alternatively, any of a variety of welding, heat sealing, adhesive, or adhesion means or techniques, or combinations thereof, may be substituted for clamping elements 64, 66. It will be appreciated that the clamping elements are best selected for manufacturing convenience; thus, the specific form of the clamping elements so employed are not material to the invention herein disclosed, nor would the specific clamping elements so selected require departure from either the scope or spirit of the present invention.

The clamping elements 64, 66 must, however, be effective both to carry the weight of the diffusion sampler 10, including its test sample, under the particular environmental and mechanical conditions at issue, and also to minimize leaking of the sample around the clamping element 64. In order to better secure the clamping elements 64, 66, and to prevent leakage therearound, the nozzle portion 30 and the top portion 50 may be provided with at least one recessed channel (not shown), either in addition to or in lieu of, shoulder portions 38, 58. Within such recessed channel may be seated the clamping element 64, 66. Additionally, a gasket material, o-ring, or inert tape (not shown) optionally and preferably may be provided in such recessed channel to assist in sealing the diffusion sampler 10 against leaks.

As the diffusion sampler 10 is being readied for use, it is inverted so that nozzle portion 30 is disposed vertically upward. Plug element 42 is disengaged from outlet portion 34. Membrane 20 is then filled with a fluid (or gas) appropriate to the test being performed, typically distilled water, in such volume as may be required by the testing protocol being utilized. A second funnel (not shown) having an outlet portion with an outside diameter of such size so as to be removably insertable into the inside diameter of outlet portion 34 may conveniently be used for this purpose. Plug element 42 is re-engaged into outlet portion 34. Finally, weighting elements and tether lines appropriate to the intended use may be affixed, at the user's discretion.

Given the often-hostile environment to which the diffusion sampler 10 may be exposed, an alternate embodiment may be provided as shown in FIG. 2. Surrounding a diffusion sampler 10, constructed in the manner described hereinabove with reference to FIG. 1, is an open-weave mesh 70. Mesh 70 may be any inert material which will allow sufficient fluid contact with the exterior of the membrane to enable the desired diffusion to occur. Mesh 70 should, further, be able to withstand abrasion, and should have sufficient mechanical strength both to accommodate and principally carry the weight of the diffusion sampler 10 and its contents.

Mesh 70 preferably is attached to diffusion sampler 10 adjacent top portion 50 through the use of heat welds 72 selectively disposed about the periphery of flange 60. Mesh 70 preferably is further attached to diffusion sampler 10 adjacent nozzle portion 30 through the use of a band clamp 74, or equivalent, selectively interlaced among alternate mesh weave portions and firmly clamped about the periphery of outlet portion 34.

The alternate embodiment of diffusion sampler 10 thus provided in accordance with FIG. 2 advantageously protects membrane 20 against detrimental abrasion in the sampling environment. Additionally, mesh 70 transfers a significant portion of those mechanical forces which would be otherwise entirely borne, disadvantageously, by the membrane 20.

In the further alternate embodiment illustrated in FIG. 3, the diffusion sampler 10 is provided without top portion 50. In lieu thereof, a loop 154, or its equivalent, may be provided in place of handle portion 54. The loop 154 may be suitably affixed to a band clamp 172, or its equivalent. Band clamp 172 is selectively interlaced among alternate mesh weave portions. Mesh 70 is gathered together when band clamp 172 is tightened. Typically, mesh 70 is able to support the membrane, including its column of water, without significant buckling of the sleeve. In this configuration, very little mechanical stress is placed upon membrane 20.

If desired, however, the upper portion of membrane 20 may be additionally stabilized by providing a reinforced link between loop 154 and the upper portion of membrane 20, in the area above seam 62. The reinforced link is desirable for the reason that the possibility of tearing of membrane 20 by loop 154 is thereby minimized.

As one example of an acceptable reinforced link (and, further, as the alternative design referenced hereinabove in the discussion of FIG. 1 with regard to top portion 50 and upper body portion 52), loop 154 may be made to pass through the upper portion of membrane 20 and through a structurally rigid tube or sleeve (not shown) which is captured within the upper portion of membrane 20 by an additional welded seam. Advantageously to the cost of the device, and where acceptable in the particular sampling environment, such an alternative design provides sufficient mechanical strength that the membrane 20 need not be captured by a top portion 50 of the form illustrated in FIGS. 1 and 2. Rather, a loop 154, in conjunction with the rigid tube or sleeve just described, provides acceptable performance of the device, optionally with or without protecting mesh 70.

It is known from the literature that aeration of the post-collection water sample degrades and makes unusable the specimen. This seemingly has been a significant problem with the prior art devices in that it is difficult to transfer the specimen to appropriate testing containers or vials without impermissibly disturbing the sample. Advantageously, the diffusion sampler 10 herein provided may be fitted with a simple valve means which may assist in avoiding problems of the type just described. As seen in FIG. 3, a novel valve arrangement is provided for use with diffusion sampler 10. A weighted ball 200, preferably with at least an inert external covering, has been inserted into nozzle portion 30 during assembly of the diffusion sampler 10, such assembly being otherwise performed according to the process described more fully hereinabove. The size of ball 200 is selected such that it has a larger outside diameter than the inside diameter of outlet portion 34, and will tend to settle into the opening between the base of funnel 32 and the top of outlet portion 34. In this manner, the opening will be sealed against leakage. Following the filling of diffusion sampler 10 with, for example, distilled water, and prior to sampling, plug element 42 is installed in the manner described above. Sampling then proceeds according to the protocol being used.

Following withdrawal of the diffusion sampler 10 from the aquifer, plug element 42 is extracted from outlet portion 34. Ball 200 tends to seal the outlet portion 34 against leakage. A modified plug 210 having a small diameter sampling tube 220 is inserted in place of plug element 42. Sampling tube 220 is frictionally, but slideably, captured in a hole and riser element provided in plug 210. Sampling tube 220 is of sufficient length to reach from outside plug element 210 to just beyond the fully seated position of ball 200. When plug 210 is first inserted into outlet portion 34, however, sampling tube 220 is partially withdrawn, according to arrow C, from the inside of outlet portion 34, so that ball 200 will not be disturbed as plug 210 is inserted.

When it is desired to withdraw a water sample from within membrane 20, sampling tube 220 is slideably inserted into outlet portion 34 so that its uppermost portion touches ball 200 and slightly unseats it. The sampling tube 220, thus inserted, will carry the specimen into a sampling vial or container with a smooth, nearly laminar flow. Following collection of the sample, the sampling tube 220 is withdrawn, according to arrow C, from the inside of outlet portion 34. Ball 200, of course, will again tend to settle into the opening between the base of funnel 32 and the top of outlet portion 34. In this manner, the opening will be resealed against leakage.

While the ball valve arrangement of FIG. 3 may be preferable in certain applications, it will be recognized that such mechanism is not always required. In this regard, ball 200 may be omitted from the device. In such configuration, plug 210 and sampling tube 220 may be installed into diffusion sampler 10 prior to its use in the aquifer. In such configuration, a flow stop means, as a clip, cap, or pinch element (not shown) may be installed upon sampling tube 220 following the filling of the membrane 20. With this arrangement, plug element 42 may advantageously be omitted.

As has been previously discussed, it is advantageous to provide the diffusion sampler 10 with reusable weighting means. Weights are required to overcome positive buoyancy and to allow the device to sink below the water surface for sampling. Such weighting means may be conveniently provided in several forms.

Figure 4:
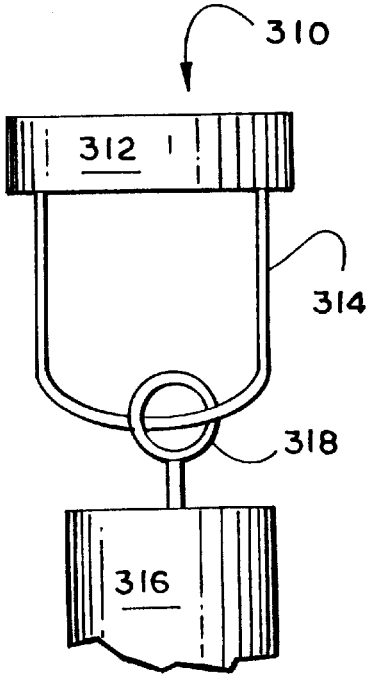

For example, a loop, similar to that shown as loop 154 of FIG. 3, may be affixed to the bottom of the sampler mesh. A weight may be removably affixed to nozzle portion 30 (FIG. 1), by mechanical means such as screws. Or, as seen in FIG. 4, a ring assembly 310 may be provided. Ring assembly 310 has a sliding ring 312 and a cable-type hanger 314. To the hanger 314 may be affixed one or more reusable weights 316. Sliding ring 312 is formed of a suitably inert material.

In use, the sliding ring 312 slides over the top of the sampler so that the long axis of the sampler passes through the center of the sliding ring 312. The sliding ring 312 seats against the bottom portion of the sampler in the area of the flange 36, because the flange 36 is of a diameter which is larger than the diameter of the sliding ring 312. The hanger 314 hangs downwardly, so that it can be connected via a hook, ring, or other attachment means to one or more preferably reusable weights 316. Preferably, a weight 316 consists of a cylindrical mass of suitably inert material, such as stainless steel, through which a hole has been bored and an eyebolt 318 inserted and secured by a nut (not shown). The eyebolt 318 and nut are of similar material as the weight 316 and can be removed for cleaning. The eyebolt 318 is secured to the assembly by way of hanger 314. The weight 316 may be removed from any individual sampler by sliding ring 312 upwardly and off the sampler and by reinstalling upon a new sampler. The ring assembly 310 may also be used to tether several samplers together.

An optional kit may be provided with the basic diffusion sampler. Within said kit may be included a funnel for filling the sampler, valve means of the type hereinabove described, and weighting means.

Although a preferred valve means has been described, it will be apparent to those ordinarily skilled in the art that alternative valve means may be provided to serve a similar purpose. It will be appreciated that the valve means are best selected for sampling convenience; thus, the specific form of the valve means so employed are not material to the construction of diffusion sampler 10 in such embodiments as are herein disclosed, nor would the specific valve means so selected require departure from either the scope or spirit of the present invention.

Having thus described exemplary embodiments of the present invention, it should be noted by those ordinarily skilled in the art that the within disclosures are exemplary only and that various other alternatives, adaptations, and modifications may be made within the scope of the present invention. Accordingly, the present invention is not limited to the specific embodiments as illustrated herein, but is only limited by the following claims.

I claim:

1. A diffusion sampling device for sampling contaminants in liquids, comprising:

a semi-permeable membrane comprising a first end, a second end, a longitudinal axis, an inside surface and an outside surface, said semi-permeable membrane shaped to form a cavity for receiving fluids, said semi-permeable membrane comprising an opening at said second end, and a substantially leak-proof seam spaced apart from said first end;

a nozzle portion comprising a longitudinal axis, said nozzle portion carried by said second end of said semi-permeable membrane, wherein said nozzle portion is in fluid communication with said opening of said semi-permeable membrane;

a top portion carried by said first end of said semi-permeable membrane;

a clamping element for removably affixing said second end of said semi-permeable membrane to said nozzle portion in substantially concentric alignment about said longitudinal axes; and, means carried by said nozzle for removably sealing said semi-permeable membrane and for filling an discharging fluid to and from said semi-permeable membrane through said nozzle.

2. A diffusion sampling device according to claim 1, further comprising an open-weave mesh material around said outside surface of said semi-permeable membrane for providing structural support and protection for said semi-permeable membrane.

3. A diffusion sampling device according to claim 1, further comprising a plug having a throughhole and a sampling tube, wherein said sampling tube extends through said throughhole of said plug, and wherein said sampling tube can be closed and opened, thus allowing liquid from said semi-permeable membrane to flow through said sampling tube to the exterior of said diffusion sampling device.

4. A diffusion sampling device according to claim 1, wherein said semi-permeable membrane is polyethylene.

5. A diffusion sampling device according to claim 1, wherein said removable sealing means is a valve.

6. A diffusion sampling device according to claim 5, wherein said valve is a ball valve.

7. A diffusion sampling device according to claim 6, further comprising a sampling tube, wherein said sampling tube is extendable through said nozzle, and wherein when said sampling tube is extended through said nozzle, said sampling tube contacts a weighted ball within said ball valve, thereby causing said weighted ball to unseat from said nozzle, and allowing liquid from said semi-permeable membrane to flow through said sampling tube to the exterior of said diffusion sampling device.

8. A diffusion sampling device according to claim 1, wherein said removable sealing means is a plug.

9. A diffusion sampling device according to claim 1, further comprising a detachable, reusable weighting means.

10. A diffusion sampling device according to claim 9 wherein said detachable weighting means further comprises a sliding ring and a hanger.

11. A diffusion sampling device for sampling contaminants in liquids, comprising:

a semi-permeable membrane comprising a first end, a second end, a longitudinal axis, an inside surface and an outside surface, said semi-permeable membrane shaped to form a cavity for receiving fluids, said semi-permeable membrane comprising an opening at said second end, and a substantially leak-proof seam spaced apart from said first end;

a frustoconically-shaped nozzle portion comprising a longitudinal axis, said nozzle portion carried by said second end of said semi-permeable membrane, wherein said frustoconically-shaped nozzle portion is in fluid communication with said opening of said semi-permeable membrane;

a top portion means carried by said first end of said semi-permeable membrane;

a clamping element for removably affixing said second end of said semi-permeable membrane to said frustoconically-shaped nozzle portion in substantially concentric alignment about said longitudinal axes;

means carried by said frustoconically-shaped nozzle for removably sealing said semi-permeable membrane and for filling and discharging fluid to and from said semi-permeable membrane through said frustoconically-shaped nozzle; and, means carried by said first end of said semi-permeable membrane for attaching weights, tether lines, and/or additional diffusion sampling devices thereto.

12. A diffusion sampling device according to claim 11, further comprising an open-weave mesh material wrapped around said outside surface of said semi-permeable membrane for providing structural support and protection for said semi-permeable membrane.

13. A diffusion sampling device according to claim 12, wherein said open-weave mesh material further comprises means carried by the lower portion of said open-weave mesh material for attaching weights, tether lines and/or additional diffusion sampling devices thereto.

14. A diffusion sampling device according to claim 11, wherein said semipermeable membrane is polyethylene.

15. A diffusion sampling device according to claim 11, wherein said removable sealing means comprises a plug having a throughhole and a sampling tube, wherein said sampling tube extends through said throughhole of said plug, and wherein said sampling tube can be closed and opened, thus allowing liquid from said semi-permeable membrane to flow through said sampling tube to the exterior of said diffusion sampling device.

16. A diffusion sampling device according to claim 11, wherein said attaching means is a frustoconically-shaped member having an opening therethrough for attaching the weights, tether lines and/or other diffusion sampling devices.

17. A diffusion sampling device according to claim 11, wherein said attaching means is a loop of material.

18. A diffusion sampling device according to claim 11, further comprising means carried by said frustoconically-shaped nozzle for attaching weights, tether lines, and/or additional diffusion sampling devices thereto.

19. A diffusion sampling device according to claim 11, further comprising means carried by said second end of said semi-permeable membrane for attaching weights, tether lines and/or additional diffusion sampling devices thereto.

20. A diffusion sampling device according to claim 19 wherein said means carried by said second end of said semi-permeable membrane for attaching weights, tether lines and/or additional diffusion sampling devices thereto comprises a detachable sliding ring and a hanger.

* * * * *